US007533847B2

(12) United States Patent
VeRost

(10) Patent No.: US 7,533,847 B2
(45) Date of Patent: May 19, 2009

(54) STORAGE RACK FOR TEMPORARY IRRIGATION SYSTEM

(75) Inventor: Scott P. VeRost, Grand Island, NY (US)

(73) Assignee: Rain King, Inc., Grand Island, NY (US)

( * ) Notice: Subject to any disclaimer, the term of this patent is extended or adjusted under 35 U.S.C. 154(b) by 33 days.

(21) Appl. No.: 11/800,128

(22) Filed: May 4, 2007

(65) Prior Publication Data

US 2008/0272224 A1 Nov. 6, 2008

(51) Int. Cl.
*B65H 75/00* (2006.01)

(52) U.S. Cl. ..... 242/594.5; 242/594.6; 242/403; 242/557; 239/198; 239/736

(58) Field of Classification Search ..... 242/590, 242/594.1–594.6, 595, 596.4, 403, 390.7, 242/557; 239/198, 736
See application file for complete search history.

(56) References Cited

U.S. PATENT DOCUMENTS

| | | | | |
|---|---|---|---|---|
| 2,705,114 | A | 3/1955 | Worsham | |
| 3,733,028 | A | 5/1973 | McVey | |
| 4,148,445 | A | 4/1979 | Reynolds et al. | |
| 4,586,677 | A | 5/1986 | Nevarez | |
| 4,649,954 | A | 3/1987 | Dunwoody | |
| 5,366,023 | A | 11/1994 | Souza | |
| 5,394,812 | A | 3/1995 | Dunning et al. | |
| 5,509,671 | A | 4/1996 | Campbell | |
| 5,687,928 | A | 11/1997 | Lassiter | |
| 6,216,962 | B1 | 4/2001 | Krieg | |
| 6,305,409 | B1 | 10/2001 | Furness | |
| 6,481,665 | B2 * | 11/2002 | Walker | 242/594.6 |
| 6,892,977 | B2 * | 5/2005 | Boone et al. | 242/595.1 |
| 6,913,221 | B2 | 7/2005 | Moon et al. | |
| 6,932,294 | B1 | 8/2005 | Larson | |
| 7,004,405 | B1 | 2/2006 | Elmore et al. | |
| 7,124,980 | B2 | 10/2006 | Giovannoni | |

FOREIGN PATENT DOCUMENTS

| | | |
|---|---|---|
| FR | 2 710 273 | 3/1995 |

* cited by examiner

*Primary Examiner*—Sang Kim
(74) *Attorney, Agent, or Firm*—Simpson & Simpson, PLLC

(57) ABSTRACT

A storage rack for an irrigation system, comprising at least a first pair of parallel rails arranged on a first substantially horizontal plane, operatively arranged to hold at least one spool, at least a second pair of parallel rails arranged on a second substantially horizontal plane, the plane located beneath the first plane, and the second pair of parallel rails located directly beneath the at least first pair of parallel rails, the second pair of parallel rails operatively arranged to hold at least one spool, cranking means operatively arranged to selectively engage and simultaneously drive two spools, where one of the two spools is located on one of the at least first pair of parallel rails, and a second of the two spools is located on one of the at least second pair of parallel rails.

24 Claims, 10 Drawing Sheets

STORAGE RACK FOR TEMPORARY IRRIGATION SYSTEM

FIELD OF THE INVENTION

The invention broadly relates to irrigation systems and, more specifically, to temporary irrigation systems, and, even more specifically, to a temporary irrigation system comprising a vehicle arranged to hold a plurality of spools of garden hoses.

BACKGROUND OF THE INVENTION

Home owners starting a new lawn often require above-ground sprinkler services to water their lawns to commence growth. This task can require hundreds of feet of garden hose and several dozen sprinkler heads to effectively complete a job over a three week period of time. The garden hose is usually stored on a plurality of spools. The task requires transport and deployment of a large amount of equipment in a relatively short amount of time. Eventually after the hoses and sprinklers are deployed and the lawn has grown adequately, all the equipment must be removed, reloaded and transported to the next lawn that requires an irrigation system.

Therefore, there is a long-felt need for a temporary irrigation system that will allow landscapers or homeowners to quickly and easily transport, deploy, and reload their equipment while also sufficiently watering lawns.

BRIEF SUMMARY OF THE INVENTION

The present invention broadly comprises a storage rack for an irrigation system, comprising at least a first pair of parallel rails arranged on a first substantially horizontal plane, operatively arranged to hold at least one spool, at least a second pair of parallel rails arranged on a second substantially horizontal plane, the second plane located beneath the first plane, and the second pair of parallel rails located directly beneath the at least first pair of parallel rails, the second pair of parallel rails operatively arranged to hold at least one spool, cranking means operatively arranged to selectively engage and simultaneously drive two spools, where one of the two spools is located on one of the at least first pair of parallel rails, and a second of the two spools is located on one of the at least second pair of parallel rails.

The cranking means allows the spools to either be cranked manually or by a powered motor. In the manual crank embodiment a square, shaft engages with the square hole in the side of the spool. The square shaft is attached to a handle which the operator can turn to wind or unwind the hose from the spool. A ratcheting device may be included on the crank so that the spool can only be cranked in one direction at a time. In the embodiment with the powered, motor, a gearing system allows the operator to individually engage the spool of his choice from among the four end spools.

The gearing system includes an engaging mechanism, wherein a smaller square shaft is housed within a larger hollow shaft. The large hollow shaft is run through a bearing and attached to a sprocket which is connected to and rotated by the output of the motor. The smaller inside shaft moves freely from side to side to engage or disengage with the axially located square holes in the spools. The inner square shaft is only long enough to engage one horizontally adjacent spool at a time. Preferably, a foot operated switch controls the powered gearing system, which frees up the operator's hands for other tasks such as managing the hoses.

One object of the invention is to provide a system to be installed temporarily for irrigating lawns.

A second object of the invention is to provide an aforementioned irrigation system that allows its user to quickly and easily unload and pack up the hoses and other equipment necessary for irrigation.

These and other objects, features and advantages of the present invention will become readily apparent to those skilled in the art upon reading the detailed description of the invention as shown in the drawings.

BRIEF DESCRIPTION OF THE DRAWINGS

The nature and mode of the operation of the present invention will now be more fully described in the following detailed description of the invention taken with the accompanying drawing Figures, in which.

DETAILED DESCRIPTION OF THE INVENTION

At the outset, it should be appreciated that like drawing numbers on different drawing views identify identical structural elements of the invention. While the present invention is described with respect to what is presently considered to be the preferred embodiments, it is understood that the invention is not limited to the disclosed embodiments. Also, the adjectives, "front," "rear," "left," "right," "top," and "bottom" and their derivatives, in the description herebelow, refer to the perspective of one facing the invention as it is shown in the figure under discussion.

Furthermore, it is understood that this invention is not limited to the particular methodology, materials and modifications described and as such may, of course, vary. The present invention is intended to cover various modifications and equivalent arrangements included within the spirit and scope of the appended claims. It is also understood that the terminology used herein is for the purpose of describing particular aspects only, and is not intended to limit the scope of the present invention, which is limited only by the appended claims.

Structure

Figure 1:
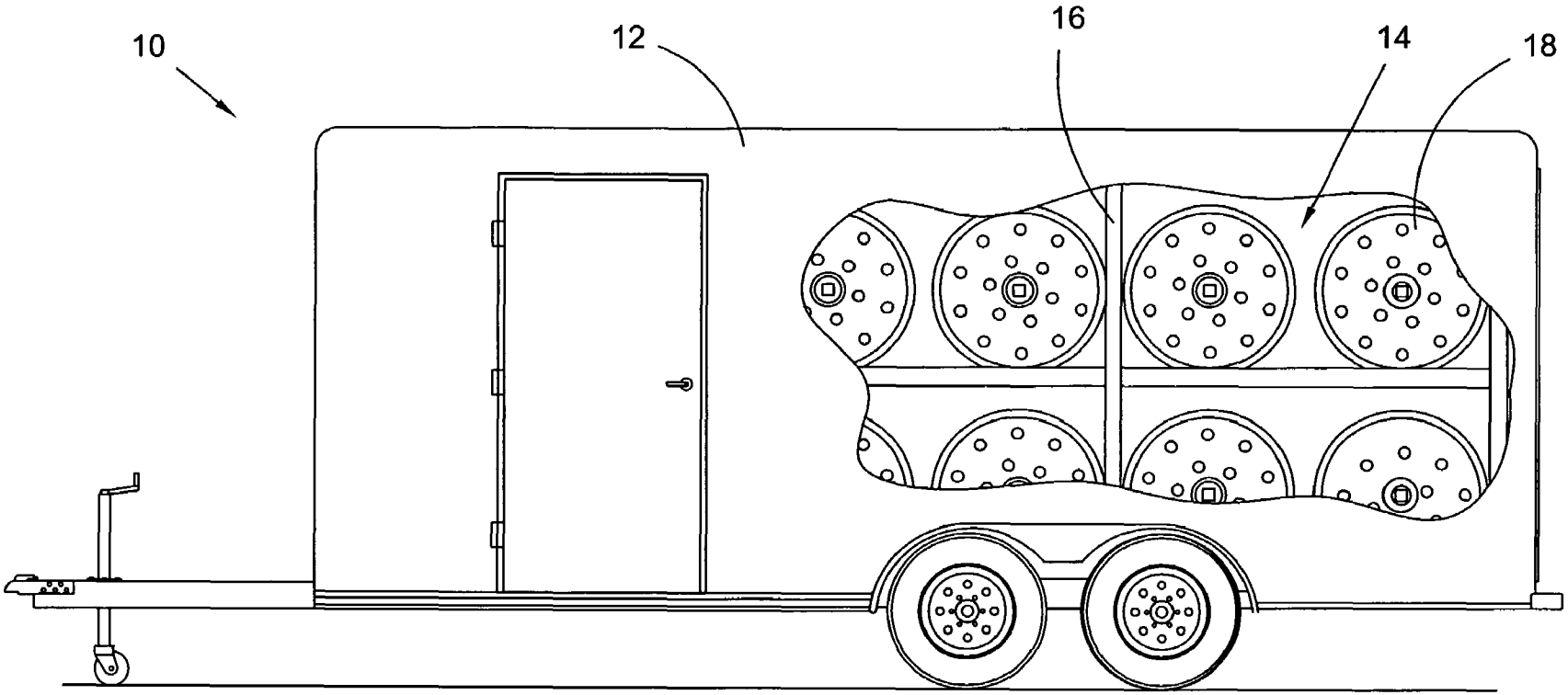
FIG. 1 is a fragmentary side view of irrigation system 10 with a section revealing the inside of trailer 12.
Figure 2A:
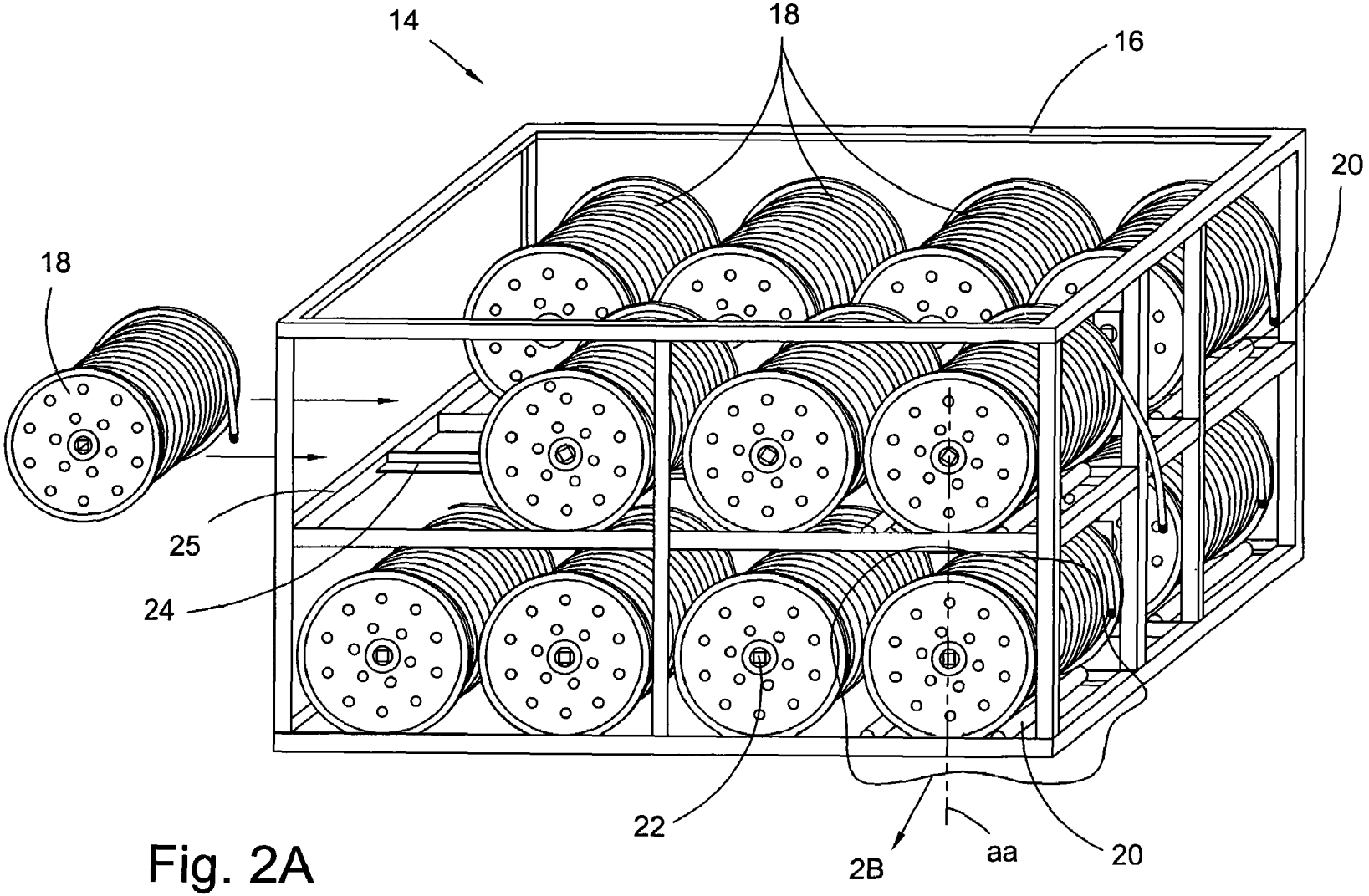
FIG. 2A is a perspective view of storage apparatus 14, showing spools 18 stored on rack 16.

Adverting now to the figures, FIG. 1 is a fragmentary side view of irrigation system 10, with a section of trailer 12 cut away to reveal storage apparatus 14 comprising rack 16 which holds a plurality of spools 18. Garden hose 26 is wound around each spool 18. A square hole 22 is located axially in each spool 18. In a preferred embodiment, storage apparatus 14 is enclosed within trailer 12. FIG. 2A shows storage apparatus 14 without trailer 12. It should be appreciated that, in a preferred embodiment, storage apparatus 14 is arranged within an enclosed trailer to protect the spools, hoses and related equipment from the elements, but the enclosed trailer is an alternative embodiment of the invention as claimed.

In a preferred embodiment, spools 18 are stacked in two sets of two rows, with all four rows substantially parallel to one another, and with the first set of rows on a different plane beneath the second set of rows. Each row is defined by a pair of rails 24. It should be appreciated that, although in a preferred embodiment, the rails are not only parallel to one another, but substantially parallel to the ground as well, this is not a necessary aspect of the invention. In fact, it may be preferable to arrange the rows/rails at a slight incline, with individual spools held in place by a locking mechanism for transport, such that gravity could assist in loading or unloading the spools. In fact, it may be preferable to incline the rows/rails in a first direction for loading and in a second direction for unloading. For example, the rails could be arranged to decline toward the rear of the rack for unloading; and decline toward the front of the rack for loading.

Figure 7:
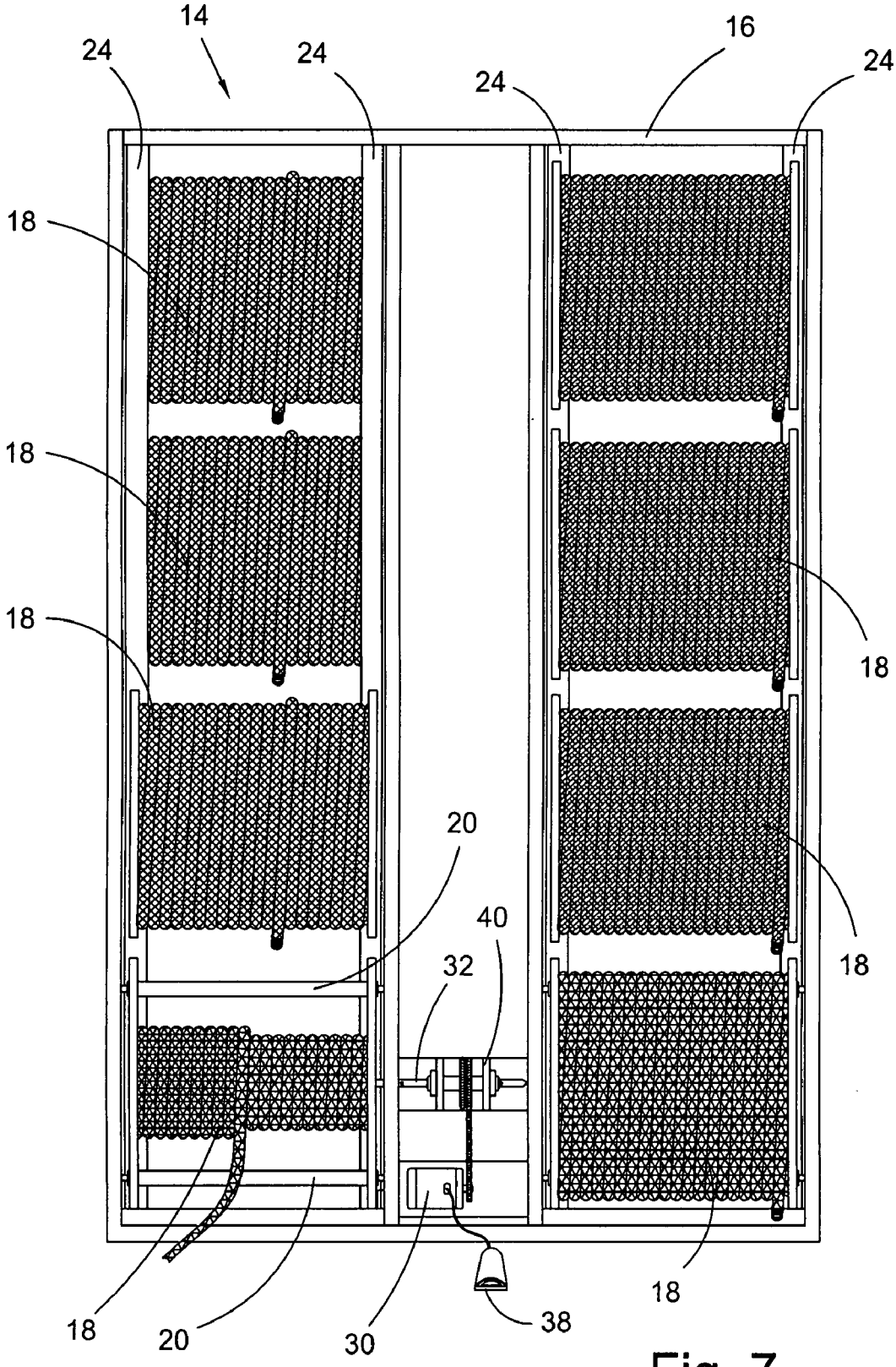

In the embodiment shown in the drawings there are four spools 18 in each row for a total of sixteen spools 18. The number of spools 18, and the number of rows, may vary in different embodiments as space permits. On the left side of FIG. 2A it is illustrated how spools 18 can be loaded onto rack 16. Rack 16 comprises rails 24 with L-shaped cross-sections upon which each row of spools 18 rest. A set of rollers 20 is positioned at the end of each row, making four sets of rollers 20 in total. FIG. 7, which shows a top view of rack 16 partially filled with spools, further illustrates how the spools rest on the L-shaped rails, and how the spools at the end of each row rest on the set of rollers.

It should be appreciated that, in a preferred embodiment, the rails on the upper rack level are in registration with the rails on the lower level. That is, the rails are aligned directly atop one another as shown in top view in FIG. 7. Although not critical to the invention as claimed, this arrangement is preferred since it optimized available storage space within the rack. FIG. 7 also shows a full rightward top rack of four spools, and a partially full leftward top rack containing one full spool, and one spool in the bottom left of the drawing (on the top rack) that has been partially unwound. The spool in the bottom leftward rack in FIG. 7 has been removed to better illustrate the partially unwound spool.

Figure 2B:
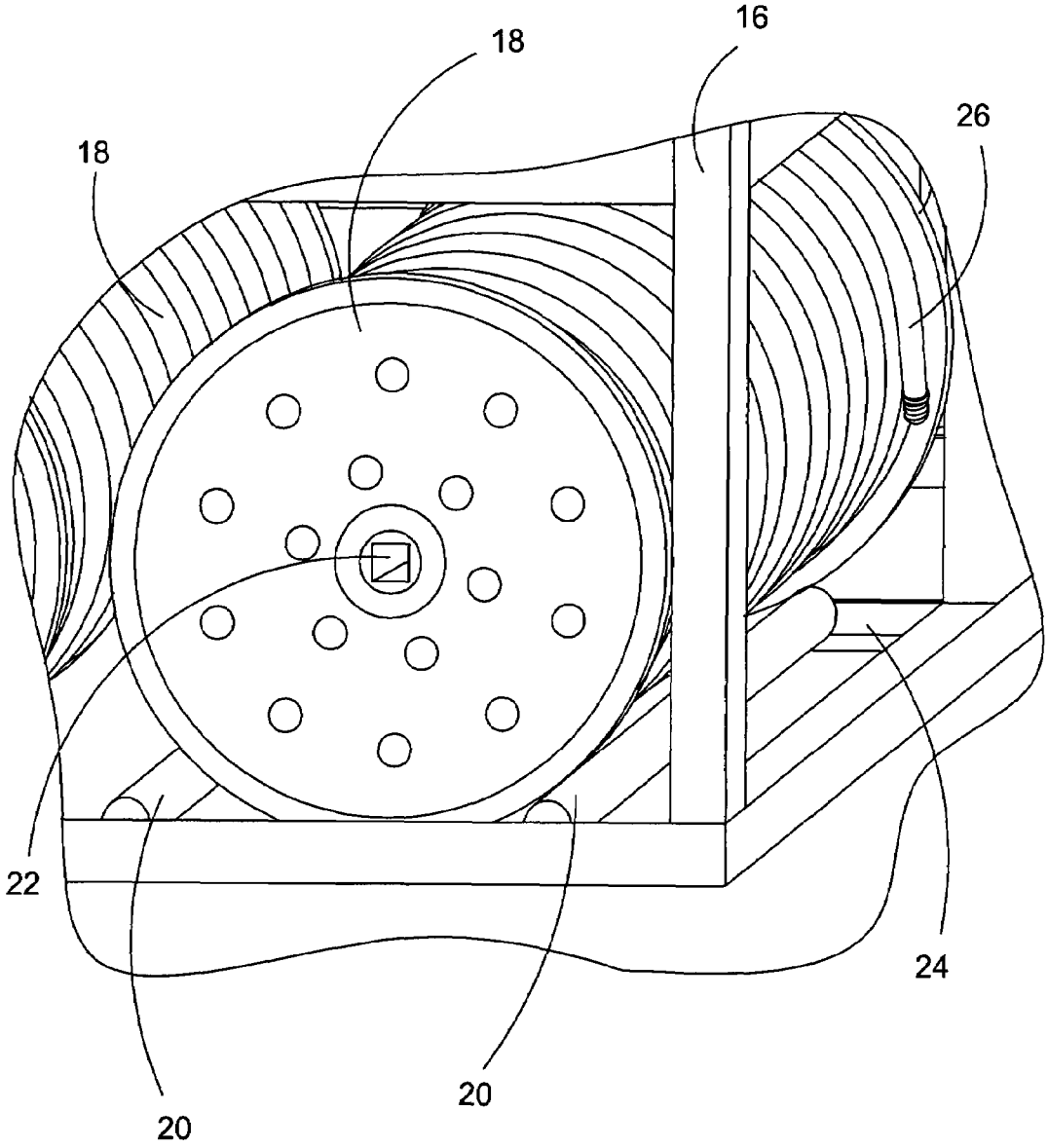
FIG. 2B is an enlarged view of the encircled area in FIG. 2A showing spool 18 ready to be used by the operator.
Figure 3:
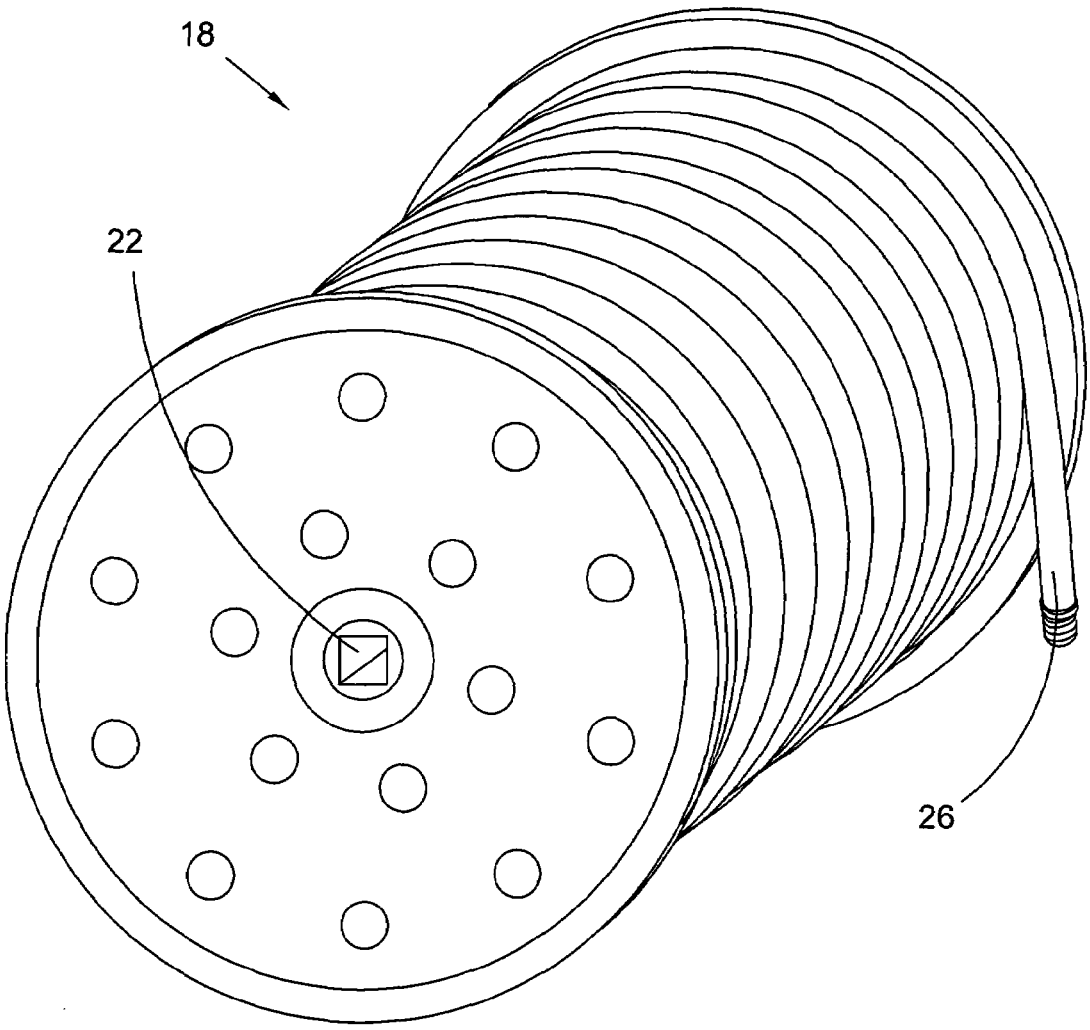
FIG. 3 is a perspective view of spool 18.

FIGS. 2B and 3 show an enlarged view of spool 18 in position at the end of the row and without the rack, respectively. FIG. 2B shows how spool 18 at the end of the row does not rest on rails 24 but instead rests on set of rollers 20. Moreover, as shown in FIG. 2A, in a preferred embodiment the axes of the two upper and lower spools resting on the rollers, share a common vertical axis aa. Although this is not a critical aspect of the invention (the upper and lower rollers could be staggered), this arrangement functions to optimize available storage space.

Figure 4A:
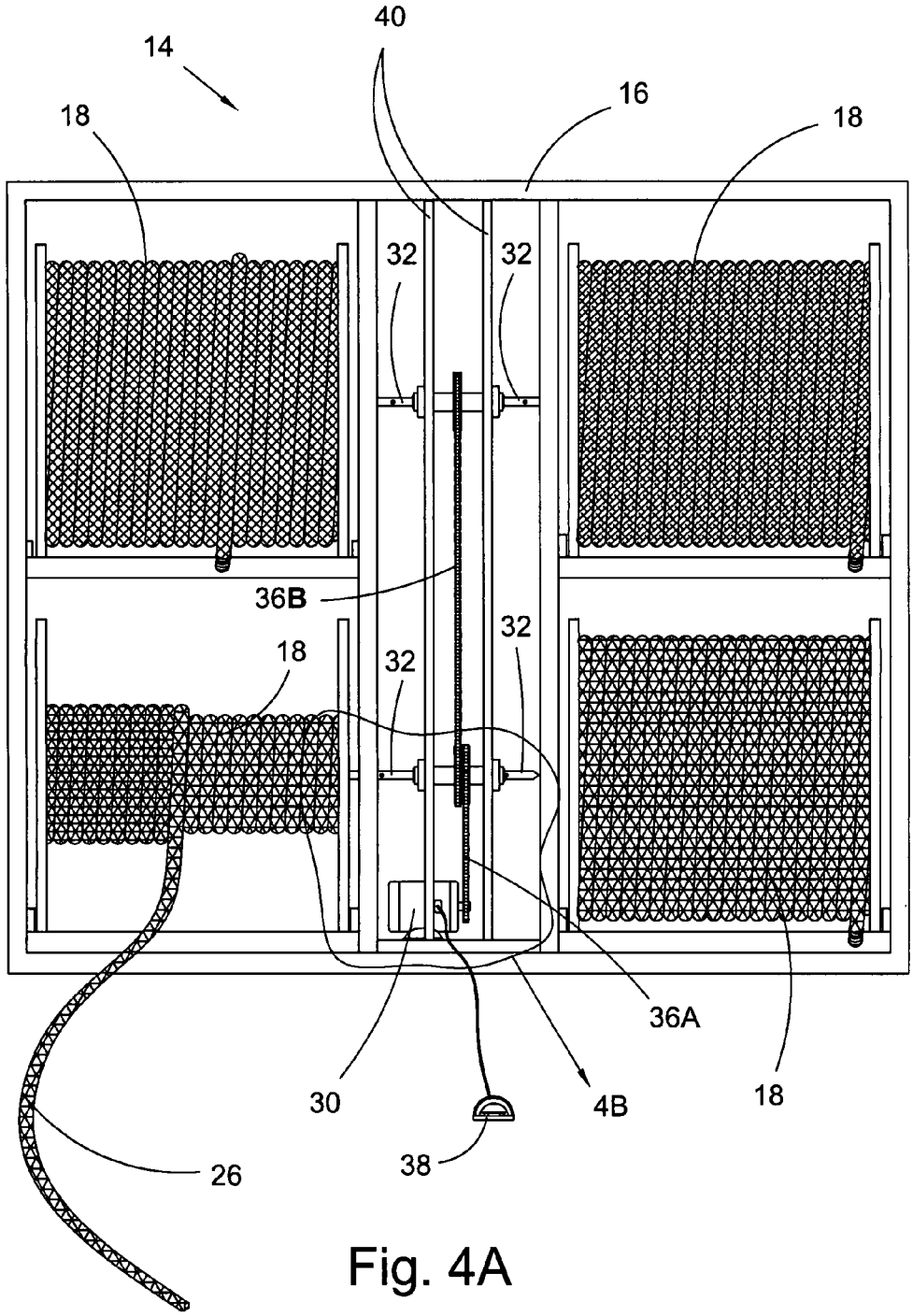
FIG. 4A is a rear view of storage apparatus 14 taken from the right in FIG. 1.

FIG. 4A shows a rear view of storage apparatus 14, as seen facing the rear door of trailer 12. This view shows a preferred embodiment which includes a motor powered cranking means. In this embodiment, shown in FIGS. 4A, 4B, and 4C, motor 30 is connected, preferably by chains 36A and 36B to a series of sprockets 31A, 31B, and 31C. In this embodiment chain 36A is attached to first sprocket 31A, which is attached to outer shaft 34. Outer shaft 34 is hollow and has a square cross-section. Second sprocket 31B is affixed to first sprocket 31A. Second chain 36B connects second sprocket 31B to third sprocket 31C. Third sprocket 31C is also connected to outer shaft 34.

Both outer shafts 34 run through a set of bearings 35. Bearings 35 are affixed to support beams 40. Inner shaft 32 which has a solid square cross-section is housed within outer shaft 34.

Figure 6:
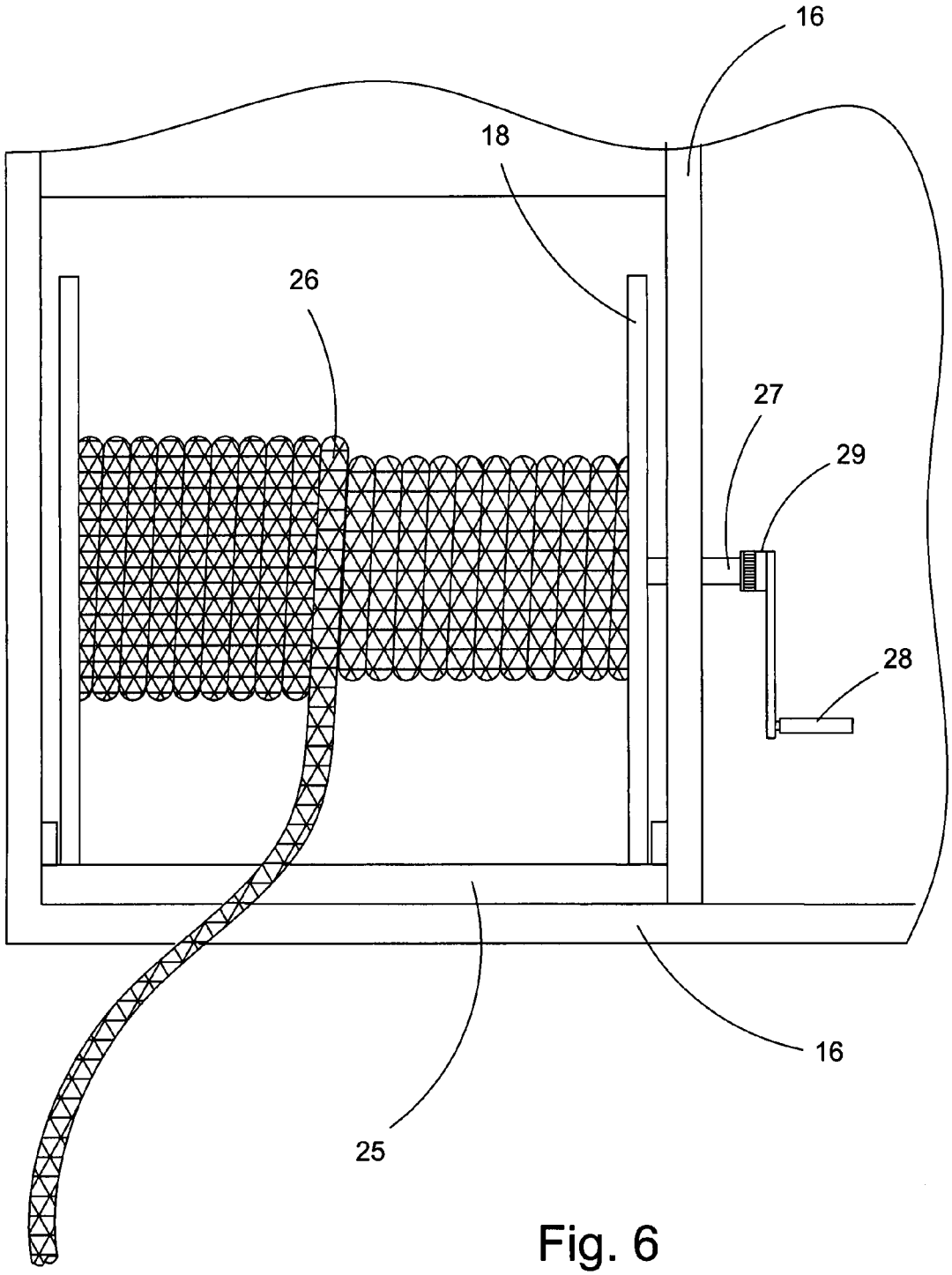
FIG. 6 is a front view of spool 18 in an embodiment with a manual cranking means; and, FIG. 7 is a top view of a partially filled rack illustrating how the spools rest on rails 24 and that the rails are substantially parallel.

FIG. 6 shows the manual cranking means which includes square shaft 27, and crank handle 28, and ratchet 29. Square shaft 27 is shown inserted into square hole 22 on the side of spool 18. Ratcheting device 29 is the intermediary between square shaft 27 and handle 28.

Operation

FIG. 2A shows how, in a preferred embodiment, spools 18 are not attached to rack 16. Since the spools 18 are not attached, and are free to roll along the racks, they can be quickly and easily loaded or unloaded. This allows the user the option to bring only the number of spools 18 necessary for each job, or to leave some spools on the racks in order to free up room for additional equipment. Rails 24 act to keep spools 18 from laterally falling off rack 16. Cross beam 25 may be included to help keep spools 18 from falling off. The last spools 18 are the ones which are available for use when the back door of the trailer is opened. A set of rollers 20 is located at the end of each row so that last spools 18 can roll in place. By rolling in place hoses 26 can be wound on or unwound from their corresponding spool 18 while keeping the position of the spool 18 stationary. There are four sets of rollers 20; one set for each spool 18 which is available for use when the rear door of the trailer 12 is opened. These four available spools 18 are displayed in FIG. 4A.

FIG. 4A also shows an embodiment with a motorized cranking system. In this embodiment motor 30 powers chain 36A which ultimately rotates outer shaft 34 by rotating sprocket 31A which is affixed to outer shaft 34. The tolerance between inner shaft 32 and outer shaft 34 is such that inner shaft 32 can smoothly slide back and forth, but also so that when outer shaft 34 rotates, so does inner shaft 32. Motor 30 is activated by foot switch 38 so that the hands of the operator are free to manipulate the hose that is being wound or unwound.

Figure 4B:
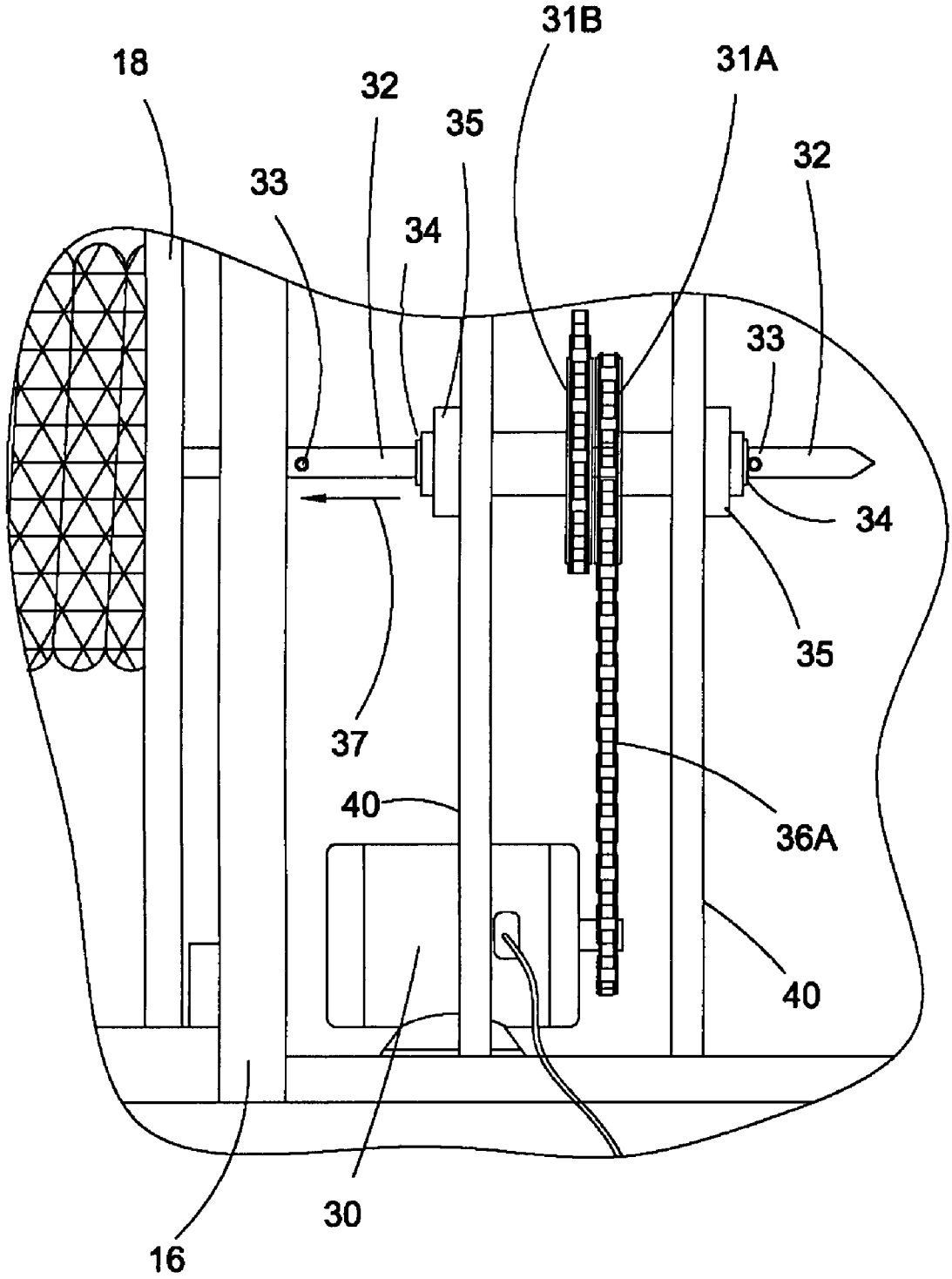
FIG. 4B is an enlarged view of the encircled area in FIG. 4A showing spool 18 on the left engaged with the gearing system and spool 18 on the right disengaged.
Figure 4C:
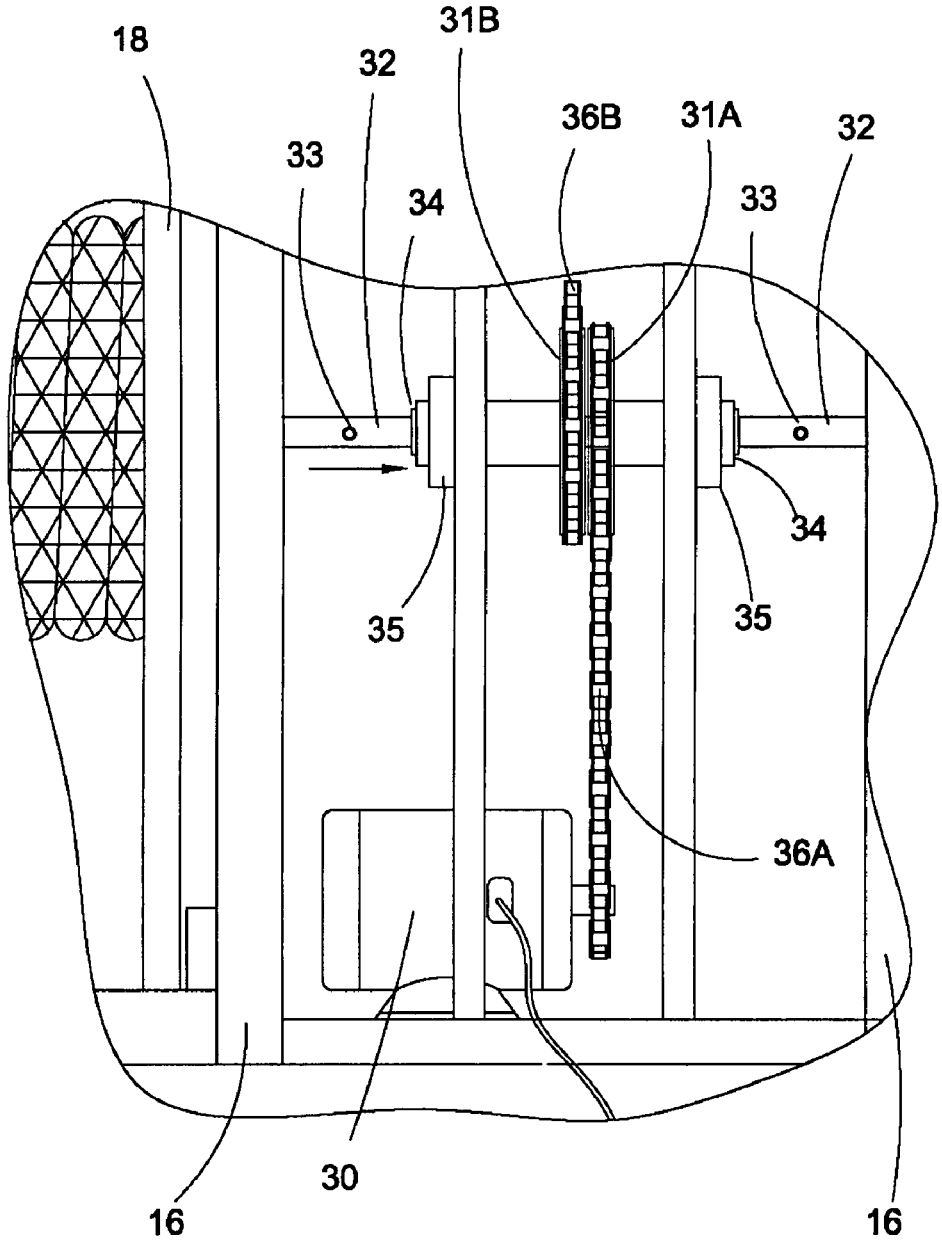
FIG. 4C is an enlarged view of the encircled area in FIG. 4A showing spools 18 on both the left and the right disengaged from the gearing system.

Arrow 37 in FIG. 4B, which is included for demonstrational purposes only, indicates that inner shaft 32 has been moved in the direction that arrow 37 is pointing. Inner shaft 32 is therefore illustrated as being engaged with square hole 22 located on the side of spool 18 on the left side of the figure. Pins 33 may be included on inner shaft 32 to delimit the distance that inner shaft 32 may travel. Also shown in FIG. 4B are bearings 35 which are secured to support beams 40, and that allow outer shaft 34 to rotate freely. FIG. 4C illustrates a similar view as in FIG. 4B, but with inner shaft 32 in a neutral position. In this figure neither of the two spools is engaged.

Figure 5A:
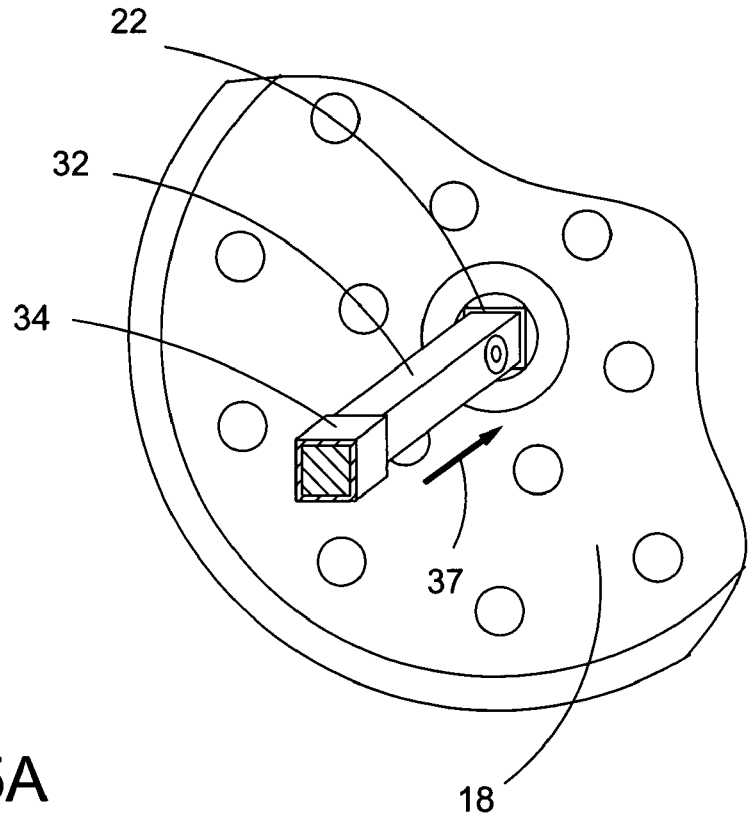
FIG. 5A illustrates spool 18 engaged with the gearing system.
Figure 5B:
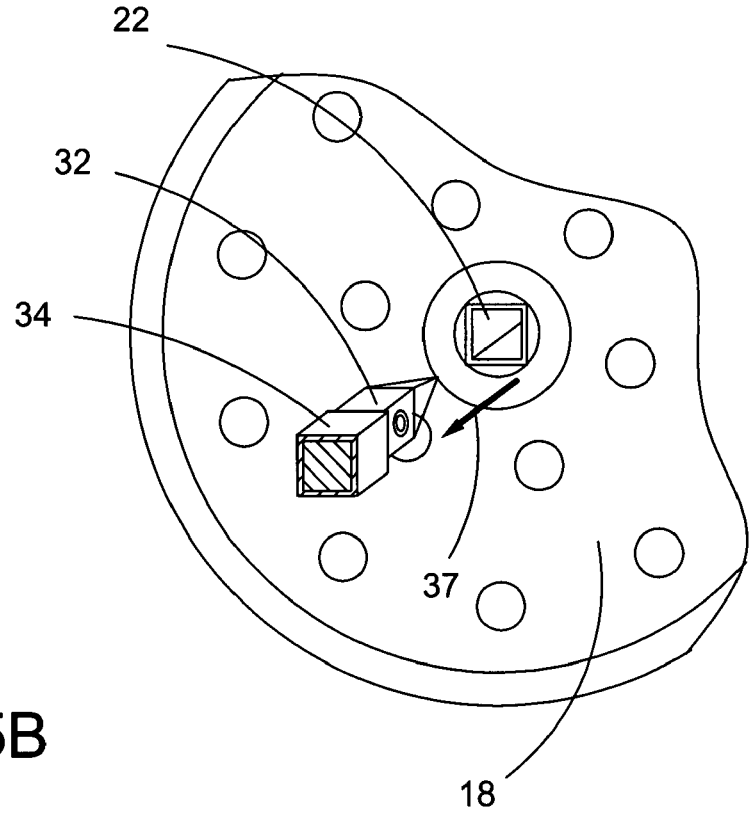
FIG. 5B illustrates spool 18 disengaged with the gearing system.

Engagement and disengagement of spools 18 is illustrated in FIGS. 5A and 5B, respectively. Arrow 37, which is again included for demonstrational purposes only, is shown pointing in the direction that inner shaft 32 has been moved. Inner shaft 32 enters square hole 22 in the side of spool 18, as shown in FIG. 5A. Once they are engaged, rotation of inner shaft 32 will cause spool 18 to also rotate. This allows for hose 26 to be unwound from spool 18 to be put into use or wound back up to removed from use. Generally only one spool 18 will be engaged at any given time, but the operator has the choice to engage a set of vertically adjacent spools 18 if it is so desired.

FIG. 6 shows spool 18 with its corresponding hose 26 partially unwound in an embodiment using a manual crank. In this embodiment square shaft 27 is inserted into square hole 22 on the side of spool 18. The operator can then crank spool 18 by hand by use of handle 28. Ratcheting device 29 may be included so that only one direction of cranking will rotate spool 18.

Thus, it is seen that the objects of the invention are efficiently obtained, although changes and modifications in the invention may be readily appreciated by those having ordinary skill in the art, and those changes and modifications are intended to be within the scope of the claims.

What I claim is:

1. A storage rack for an irrigation system, comprising:

a first pair of parallel rails arranged on a first substantially horizontal plane, said first pair of rails operatively arranged to hold at least one spool;

a second pair of parallel rails arranged on a second substantially horizontal plane, said plane located beneath said first plane, and said second pair of parallel rails located directly beneath said first pair of parallel rails, said second pair of parallel rails operatively arranged to hold at least one spool;

cranking means operatively arranged to selectively engage and then simultaneously drive two spools or individually drive either one of said two spools, where one of said two spools is located on said first pair of parallel rails, and a second of said two spools is located on said second pair of parallel rails.

2. The storage rack recited in claim 1 wherein said storage rack further comprises a set of rollers rotatably affixed at one end of said first pair of rails perpendicular to said rails and between said first pair of rails.

3. The storage rack recited in claim 1 wherein said storage rack further comprises a set of rollers rotatably affixed at one end of said second pair of rails perpendicular to said rails and between said second of rails.

4. The storage rack recited in claim 1 wherein said storage rack further comprises at least one spool residing on said storage rack.

5. The storage rack recited in claim 4 wherein a garden hose is wound around each said spool.

6. The storage rack recited in claim 1 wherein said cranking means is a manual hand crank.

7. The storage rack recited in claim 6 wherein said manual hand crank includes a ratcheting device for allowing only one direction of cranking to rotate said spool.

8. The storage rack recited in claim 1 wherein said cranking means is powered by a motor.

9. The storage rack recited in claim 8 wherein said motor powered cranking means includes a switch to be activated by foot.

10. The storage rack recited in claim 1 in combination with a vehicle operatively arranged to hold said storage rack.

11. The storage rack recited in claim 10 wherein said vehicle is a trailer enclosed about said storage rack.

12. The storage rack recited in claim 10 wherein said vehicle is a pickup truck.

13. A storage rack for an irrigation system, comprising:

at least a first pair of parallel rails arranged on a first substantially horizontal plane, said first pair of rails operatively arranged to hold at least one spool;

at least a second pair of parallel rails arranged on a second substantially horizontal plane, said plane located beneath said first plane, and said second pair of parallel rails located directly beneath said at least first pair of parallel rails, said second pair of parallel rails operatively arranged to hold at least one spool;

cranking means operatively arranged to selectively engage and then simultaneously drive up to at least one spool from each of said at least one first pair of rails and said at least one second pair of rails.

14. The storage rack recited in claim 13 wherein said storage rack further comprises a set of rollers rotatably affixed at one end of said first pair of rails perpendicular to said rails and between said first pair of rails.

15. The storage rack recited in claim 13 wherein said storage rack further comprises a set of rollers rotatably affixed at one end of said second pair of rails perpendicular to said rails and between said second of rails.

16. The storage rack recited in claim 13 wherein said storage rack further comprises at least one spool residing on said rails.

17. The storage rack recited in claim 16 wherein a garden hose is wound around each said spool.

18. The storage rack recited in claim 13 wherein said cranking means is a manual hand crank.

19. The storage rack recited in claim 18 wherein said manual hand crank includes a ratcheting device for allowing only one direction of cranking to rotate said spool.

20. The storage rack recited in claim 13 wherein said cranking means is powered by a motor.

21. The storage rack recited in claim 20 wherein said motor powered cranking means includes a switch to be activated by foot.

22. The storage rack recited in claim 13 in combination with a vehicle operatively arranged to hold said storage rack.

23. The storage rack recited in claim 22 wherein said vehicle is a trailer enclosed about said storage rack.

24. The storage rack recited in claim 22 wherein said vehicle is a pickup truck.

* * * * *